US008777436B2

(12) United States Patent
Labans

(10) Patent No.: US 8,777,436 B2
(45) Date of Patent: Jul. 15, 2014

(54) BATTERY POWERED LAMP SOCKET THAT SUPPLIES ENERGY FOR LED OR CFL LIGHT BULBS

(76) Inventor: Donna Sue Labans, Cranberry Township, PA (US)

( * ) Notice: Subject to any disclaimer, the term of this patent is extended or adjusted under 35 U.S.C. 154(b) by 233 days.

(21) Appl. No.: 13/462,764

(22) Filed: May 2, 2012

(65) Prior Publication Data

US 2012/0293982 A1 Nov. 22, 2012

Related U.S. Application Data

(60) Provisional application No. 61/487,373, filed on May 18, 2011.

(51) Int. Cl.

| | |
|---|---|
| ***F21V 33/00*** | (2006.01) |
| ***H01R 13/66*** | (2006.01) |
| ***H01R 33/22*** | (2006.01) |
| ***H01R 33/08*** | (2006.01) |
| ***H01R 13/717*** | (2006.01) |
| ***H01R 27/00*** | (2006.01) |

(52) U.S. Cl.

CPC ..... *H01R 13/6675* (2013.01); *H01R 33/22* (2013.01); *H01R 33/08* (2013.01); *H01R 13/7175* (2013.01); *H01R 27/00* (2013.01)

USPC ..... 362/95; 362/157; 362/650

(58) Field of Classification Search

CPC ..... F21V 23/02–23/026

USPC ..... 362/95, 157, 183, 650

See application file for complete search history.

(56) References Cited

U.S. PATENT DOCUMENTS

2010/0141153 A1* 6/2010 Recker et al. ..... 362/20
2012/0188754 A1* 7/2012 Fitzwater et al. ..... 362/183

* cited by examiner

*Primary Examiner* — David V Bruce

(57) ABSTRACT

A standard table lamp requires an electrical outlet to supply alternating current (AC) and illuminate a standard AC light bulb, including new technology, low wattage AC light bulbs such as a 7 Watt LED or a 7 Watt CFL. This limits the placement and portability of light emitting devices such as table lamps, floor lamps, chandeliers or wall sconces within a commercial or residential living space. To date, there are products that use batteries to power light sources but the form factors are usually bland and unattractive to interior designers and homeowners alike. This invention takes the idea of portable lighting and standardizes the form factor by using already developed standard low wattage AC light bulbs such as LED and CFL and standard AC light bulb sockets embedded in the design.

15 Claims, 3 Drawing Sheets

BATTERY POWERED LAMP SOCKET THAT SUPPLIES ENERGY FOR LED OR CFL LIGHT BULBS

REFERENCE TO RELATED APPLICATIONS

This application claims the benefit of U.S. Provisional Application No. 61/487,373 filed May 18, 2011, which is incorporated by reference

BACKGROUND OF THE INVENTION

With the development of new low wattage illumination technologies like Compact Fluorescent (CFL) and Light Emitting Diode (LED) the possibility of having low wattage battery operated portable illumination in living spaces has become a reality.

Presently, there are products that use batteries to power portable light devices; however, the form factors are usually bland and unattractive to interior designers and homeowners alike. Additionally, existing battery powered light devices use direct current energy to power a nonstandard DC light bulb which makes replacing the non-standard DC light bulb or illuminator a problem.

BRIEF SUMMARY OF THE INVENTION

The present invention relates to a battery powered portable lamp socket that supplies alternating current energy for standard thread low wattage alternating current LED or CFL light bulbs.

This invention takes this idea of portable lighting and standardizes the form factor by using already developed standard thread AC light bulb sockets embedded in the design. Additionally, because the invention models itself after a standard table lamp light bulb socket assembly it becomes an easy retrofit replacement for any table lamp, floor lamp, chandelier or wall sconce that contains a standard threaded lamp light bulb socket assembly.

The table lamp owner only needs to cut and remove the existing AC power cord and then unscrew the light bulb socket assembly from the table lamp, then install the present invention or battery powered lamp socket by screwing it back on the table lamp. Replace the light bulb with a low wattage LED or CFL light bulb and turn on the lamp socket switch.

BRIEF DESCRIPTION OF THE DRAWINGS

In order to more fully describe the embodiments of the present invention, reference is made to the accompanying drawings, wherein.

DETAILED DESCRIPTION OF THE INVENTION

The description above and below and the drawings of the present document focus on one or more currently preferred embodiments of the present invention and describe some exemplary optional features and/or alternative embodiments. The description and drawings are for the purpose of illustration and are not limitations of the present invention.

Figure 1:
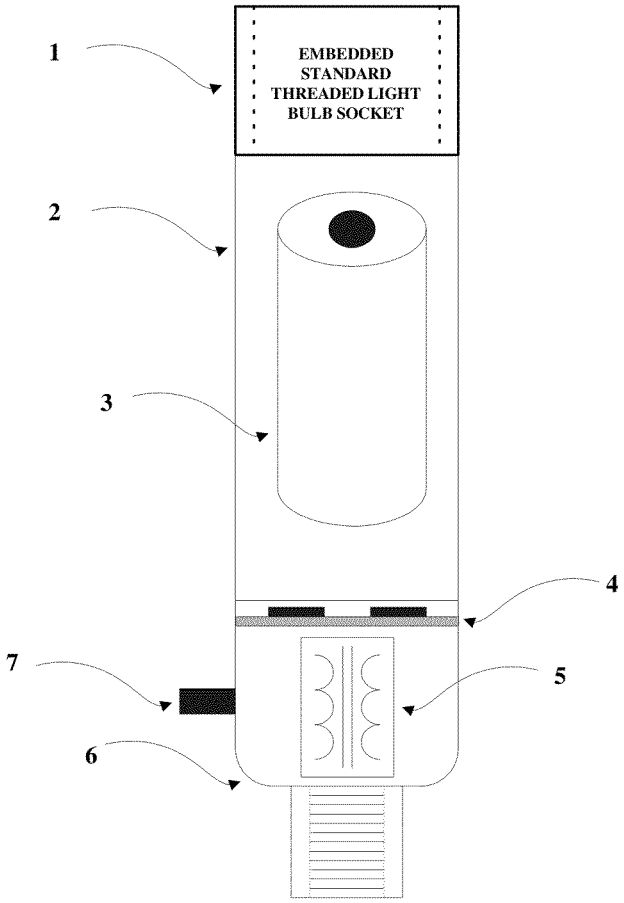
FIG. 1 is a perspective view of the battery powered lamp socket according to an embodiment of the present invention.

FIG. 1 is a perspective view of the battery powered lamp socket according to an embodiment of the present invention. The embodiment shown in the drawing includes a removable AC energy receptacle housing 1 connected via wiring 9 to an energy storage device housing 2 containing an energy storage device 3, that is then connected via wiring 9 to an inverter circuit card and transformer housing 6 containing a varistor 8, an AC transformer 5 and a DC to AC inverter circuit card 4 connected via wiring 9 to a series ON/OFF switch 7 that completes the circuit only in the ON position and breaks the circuit only in the OFF position.

The removable alternating current receptacle housing 1 is an electromechanical device which mates electrically and mechanically with the energy storage device housing 2 to produce alternating current energy. The removable AC receptacle housing 1 produces alternating current energy for but is not limited to an incandescent light bulb, a light-emitting diode (LED), a fluorescent lamp, a halogen lamp, or any other device known in the art that produces visible illumination with the application of voltage. Furthermore, the removable AC receptacle housing 1 can be fit with a socket to outlet adapter (already in existence) to allow a standard alternating current plug to be electrically connected to provide power to, but not limited to, electric shavers, radios, or any small appliances known in the art to require alternating current energy. While there is no limit as to the power output of the invention, the power consumption of the light emitting devices and small appliances is preferably in the range of 0.1 to 15 Watts and more preferably about 7 Watts.

The energy storage device housing 2 is an electromechanical device which houses an energy storage device 3 and mates electrically and mechanically with both the removable AC receptacle housing 1 and the inverter circuit card and transformer housing 6 to produce alternating current energy as mentioned previously.

The energy storage device 3 is preferably a direct current (DC) energy storage device that is configured to provide power to the DC to AC inverter circuit card 4. The energy storage device 3 can include any battery or cell known in the field, including general purpose batteries, alkaline batteries, lithium ion batteries, nickel-cadmium batteries, nickel metal hydride batteries, or any other batteries. Further, energy storage device 3 may include a broader array of power sources, including but not limited to fuel cells and capacitors. While there is no limit to the voltage or energy content of the energy storage device 3, it preferably ranges from a voltage of 1 to 24 volts, more preferably 9-15 volts, and more preferably about 12 volts.

Figure 2:
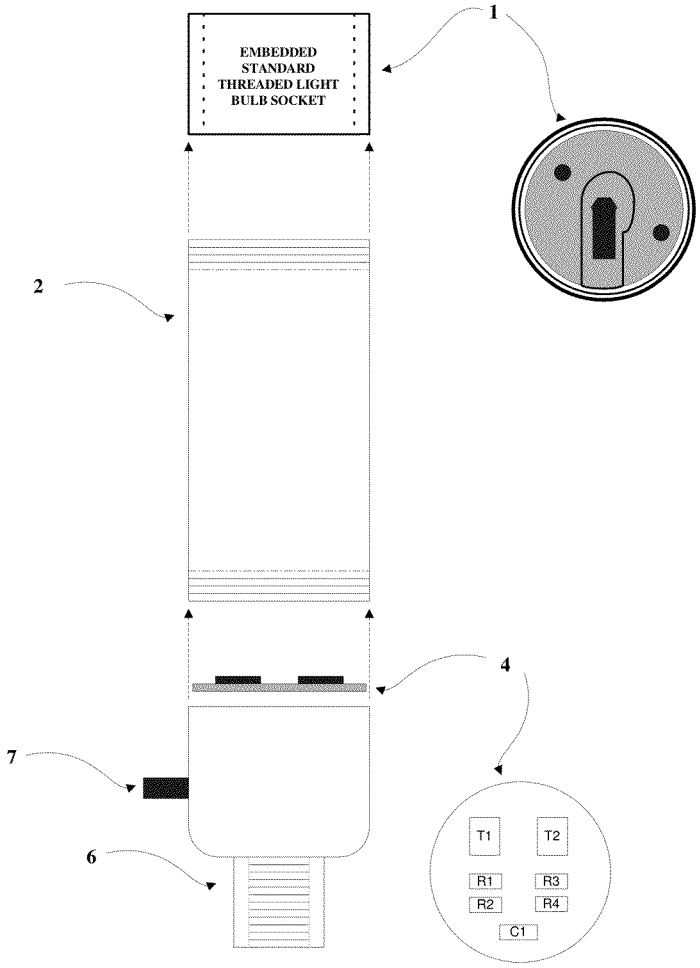
FIG. 2 is an exploded view of the battery powered lamp socket of FIG. 1.

The DC to AC inverter circuit card 4 is an electronic device that produces alternating current energy from a direct current energy storage device 3. FIG. 2 shows an exploded view of the circuit card and the electronic components that comprise it. The DC to AC inverter circuit card 4 and associated AC transformer 5 produce useable alternating current energy.

The AC transformer 5 takes the output from the DC to AC inverter circuit card 4 and steps up the voltage to a level useable by AC devices such as light emitting devices, small appliances, etc.

The inverter circuit card and transformer housing 6 is an electromechanical device that mates electrically and mechanically with the energy storage device housing 2 to produce alternating current energy. The inverter circuit card and transformer housing 6 holds both the DC to AC inverter circuit card 4 and AC transformer 5 while providing the necessary predetermined threading pattern to mechanically mate with a lamp base such as a table lamp. The inverter circuit card and transformer housing 6 as mentioned previously, contains the predetermined internal threads that will mechanically mate with but are not limited to a table lamp, a floor lamp, chandelier, wall sconce or any light emitting device so equipped with the proper threaded mechanical mating surface. Furthermore, the inverter circuit card and transformer housing 6 is not even bound to only mating with light emitting devices such as table or floor lamps, but can instead be affixed to or mechanically mated with any properly equipped threaded surface.

The ON/OFF switch 7 breaks the direct current energy circuit path to the DC to AC inverter circuit card 4 from the energy storage device 3 which subsequently stops the DC to AC inverter circuit card 4 from producing alternating current energy.

Figure 3:
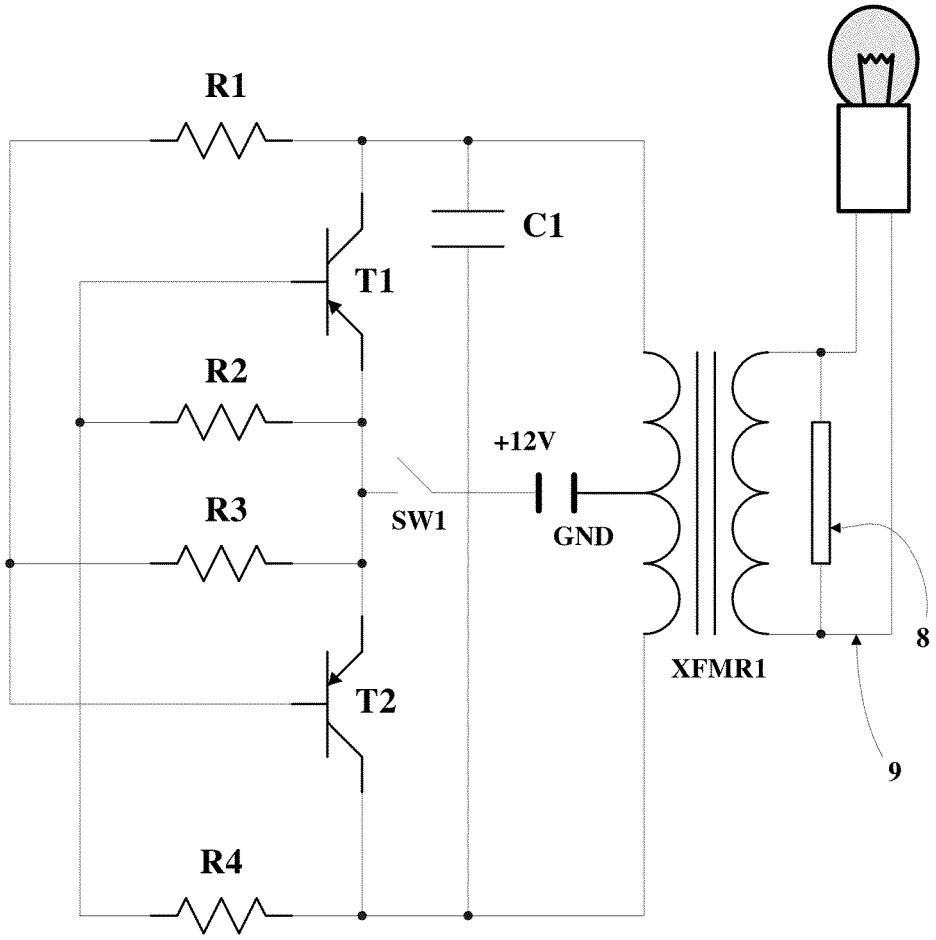
FIG. 3 is a circuit diagram of the battery powered lamp socket of FIG. 1.

The varistor 8 of FIG. 3 because of its ability to conduct large amounts of current while maintaining the same voltage during its normal conduction mode is used to jump start the CFL internal ballast.

The wiring 9 of FIG. 3 comprises a current-conducting material that electrically connects the components of the invention. It may include any material or wiring known in the art, including but not limited to copper and other metals having low electrical resistance. The wire gauge may be chosen to reduce costs while simultaneously carrying current with a minimum of resistant power dissipation.

To date, there are products that use batteries to power light sources but the form factors are usually bland and unattractive. This invention takes this idea and standardizes the form factor by using already developed standard light bulbs and standard light bulb sockets embedded in the design. Additionally, this invention because it uses a standard light bulb socket can be fitted with a socket to outlet adapter and provide portable AC power to small appliances.

While the invention does not necessarily require three separate housings, access to the energy storage device 3 is required for recharging. The invention could use a different type of inverter circuit but conversion of direct current energy from an energy storage device to alternating current energy is required. The varistor 8 when not powering a CFL light emitting device could be considered optional, but does not detrimentally affect the operation of the invention if left in circuit.

In operation, no alternating current energy is produced by the DC to AC inverter circuit card 4 when the ON/OFF switch 7 is in the OFF position and no direct current is allowed to flow to the DC to AC inverter circuit card 4 from the energy storage device 3. When a user positions the ON/OFF switch 7 in the ON position then direct current is allowed to flow from the energy storage device 3 to the DC to AC inverter circuit card 4 which produces alternating current energy which is connected electrically via wiring 8 to the removable AC receptacle housing 1 for use in powering light emitting devices or small appliances.

The present invention of FIG. 1 can be made by providing an AC receptacle housing 1 that can hold a light emitter such as an LED bulb, an energy storage device housing 2 that can hold an energy storage device 3, such as a battery, an inverter circuit card and AC transformer housing 6 with internal threads that holds a varistor 8, a DC to AC inverter circuit card 4 and an AC transformer 5 and can be mechanically connected to any device equipped with compatible threads, such as a table lamp, wiring 9 and a single ON/OFF switch 7. The components may then be connected as shown in FIG. 1 such as by soldering the connections.

FIG. 2 shows the present invention is comprised of three removable housings that provide access to energy storage devices or electronic circuitry. While some elements such as the energy storage device 3, the AC transformer 5, the DC to AC inverter circuit card 4, the ON/OFF switch 7, and the wiring 9 could be reconfigured the AC energy receptacle housing 1 still has to be accessible to the user to remove and replace light emitting devices or socket to outlet adapters. The same reasoning applies to the inverter circuit card and transformer housing 6 which contains the predetermined threaded base required to affix the invention on a lamp base or equivalent mechanically compatible threaded surface.

To use the invention, a person would insert the AC LED light bulb into the AC receptacle housing 1 by rotating the light bulb in a clockwise motion. The person could then illuminate the LED light bulb by positioning the ON/OFF switch 7 in the ON position. Then the user needs to decide where if anywhere the invention will be mounted in the commercial or residential living space? As mentioned previously, all that is required to mount the invention is a compatible threaded surface that mechanically mates with the threads provided in the inverter circuit card and transformer housing 6, such as a table lamp, floor lamp, wall sconces, etc.

The batteries are rechargeable and the battery powered lamp socket top unscrews for easy access to the batteries. After recharging, reinsert the lamp socket batteries into the battery compartment and screw the lamp socket top back on the lamp base.

The invention is not limited to providing alternating current (AC) energy to light emitting devices. It can also be used to provide AC energy to small appliances such as electric shavers and radios and even be used to power a string of holiday lights. By acquiring a socket to outlet adapter and inserting it in the AC energy receptacle housing 1 in the same fashion as a person would insert an LED light bulb, the invention can now provide power to small AC appliances with pluggable cords. While there is no limit as to the power output of the invention, the power consumption of the light emitting devices and small appliances is preferably in the range of 0.1 to 15 Watts and more preferably about 7 Watts.

The invention because it is small and light weight can be carried by an individual to provide portable AC energy to any remote location outside the home as well such as fishing, camping, hiking etc.

What is claimed is:

1. A wireless light bulb socket comprising:

an energy storage device providing direct current energy to, a direct current energy to alternating current energy converter that supplies alternating current energy to, a light bulb socket, whereby said light bulb socket will couple alternating current energy to a light emitting diode or a compact fluorescent light bulb to produce illumination from the light bulb.

2. The wireless light bulb socket of claim 1 wherein said energy storage device is housed in a predetermined plastic electromechanical housing.

3. The wireless light bulb socket of claim 1 wherein said direct current energy to alternating current energy converter is housed in a predetermined plastic electromechanical housing.

4. The wireless light bulb socket of claim 1 wherein said light bulb socket is housed in a predetermined plastic electromechanical housing to accommodate the use of predetermined light emitting diode or compact fluorescent light bulbs.

5. The wireless light bulb socket of claim 1 wherein said direct current energy to alternating current energy converter includes an ON/OFF switch that disconnects said energy storage device from said converter.

6. The wireless light bulb socket of claim 4 wherein said predetermined plastic electromechanical housing includes a varistor to act as a starter circuit for compact fluorescent light bulbs.

7. The wireless light bulb socket of claim 1 wherein said light bulb socket is of predetermined size and shape to allow the use of a Commercial-Off-The-Shelf component for plugging small appliances into light sockets.

8. A light bulb socket that fits into an existing light bulb socket comprising:

an energy storage device providing direct current energy to, a direct current energy to alternating current energy converter that supplies alternating current energy to, an Edison screw light bulb socket, whereby said light bulb socket will couple alternating current energy to a light emitting diode or a compact fluorescent light bulb to produce illumination from the light bulb.

9. The light bulb socket of claim 8 wherein said energy storage device is housed in a predetermined plastic electromechanical housing.

10. The light bulb socket of claim 8 wherein said direct current energy to alternating current energy converter is housed in a predetermined plastic electromechanical housing.

11. The light bulb socket of claim 8 wherein said light bulb socket is housed in a predetermined plastic electromechanical housing to accommodate the use of predetermined light emitting diode or compact fluorescent light bulbs.

12. The light bulb socket of claim 8 wherein said direct current energy to alternating current energy converter includes an ON/OFF switch that disconnects said energy storage device from said converter.

13. The light bulb socket of claim 11 wherein said predetermined plastic electromechanical housing includes a varistor to act as a starter circuit for compact fluorescent light bulbs.

14. The light bulb socket of claim 8 wherein said light bulb socket is of predetermined size and shape to allow the use of a Commercial-Off-The-Shelf component for plugging small appliances into light sockets.

15. A method of producing portable alternating current energy illumination in a small attractive standardized electromechanical housing comprising:

providing an energy storage device is able to supply direct current energy, providing a direct current energy to alternating current energy converter is able to generate alternating current energy from said energy storage device, providing an electromechanical housing of predetermined size and shape is able to supply alternating current to a predetermined illumination device commonly referred to in the art as a light bulb, providing said light bulb is electromechanically compatible with said housing and is of predetermined wattage, whereby said light bulb will produce visible illumination from said electromechanical housing producing said alternating current energy from said direct current energy to alternating current energy converter which converts the direct current energy from said energy storage device.

* * * * *